United States Patent [19]

Naka

[11] 4,321,294

[45] Mar. 23, 1982

[54] STAIR MAT

[76] Inventor: Hiromitsu Naka, c/o Tokyo Kenkyusho of Kabushiki Kaisha Naka Gijutsu Kenkyusho, No. 39, Oaza Shinmachi, Yashio-shi, Saitama-ken, Japan

[21] Appl. No.: 94,301

[22] Filed: Nov. 13, 1979

[30] Foreign Application Priority Data

| | | | |
|---|---|---|---|
| Nov. 13, 1978 | [JP] | Japan | 53/138855 |
| Feb. 16, 1979 | [JP] | Japan | 54/17772[U] |
| Feb. 21, 1979 | [JP] | Japan | 54/20284[U] |

[51] Int. Cl.[3] ..... B32B 3/26; E04F 11/16

[52] U.S. Cl. ..... 428/61; 428/62; 428/100; 428/212; 428/217; 428/218; 428/167; 428/188; 52/179; 52/188

[58] Field of Search ..... 428/40, 41, 44, 45, 428/47, 56–58, 61, 62, 68, 99, 101, 121, 192, 223, 212, 217, 100, 218, 167, 188; 52/179, 181, 188, 822, 827

[56] References Cited

U.S. PATENT DOCUMENTS

| | | | |
|---|---|---|---|
| 4,042,741 | 8/1977 | Bright | 428/217 |
| 4,151,320 | 4/1979 | Naka | 428/121 X |

FOREIGN PATENT DOCUMENTS

| | | | |
|---|---|---|---|
| 761150 | 6/1967 | Canada . | |
| 2122623 | 11/1972 | Fed. Rep. of Germany | 52/179 |

*Primary Examiner*—George F. Lesmes
*Assistant Examiner*—Alexander S. Thomas
*Attorney, Agent, or Firm*—Wenderoth, Lind & Ponack

[57] ABSTRACT

A stair mat is installed on the stairs in a manner as an edge cushion cover of flexible synthetic resin and a tread mat are adapted to the stairs, being adjacent each other, by the use of a connecting base sheet member having stiffness.

The connecting base sheet member is provided with a hook-shaped rib or a plurality of thorns, and the edge cushion cover is provided with a catching groove or a flexible connecting layer corresponding to the hook-shaped rib or a plurality of thorns on the under surface.

4 Claims, 11 Drawing Figures

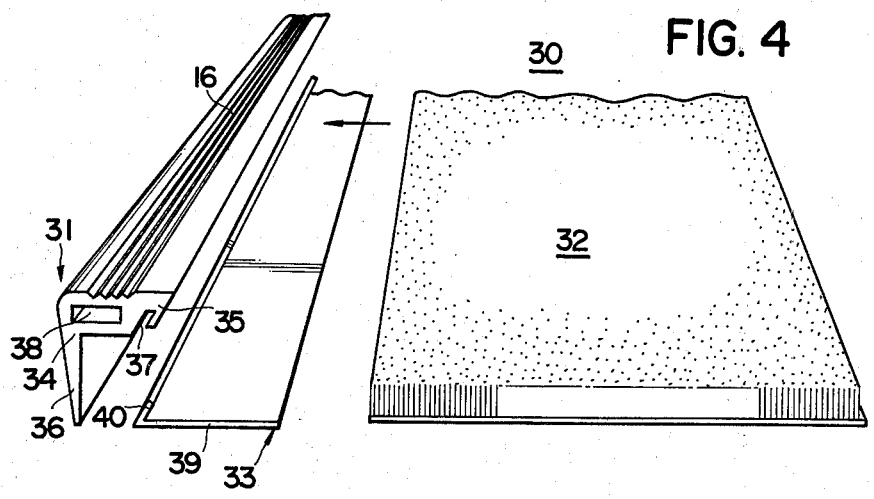
FIG. 4
FIG. 5
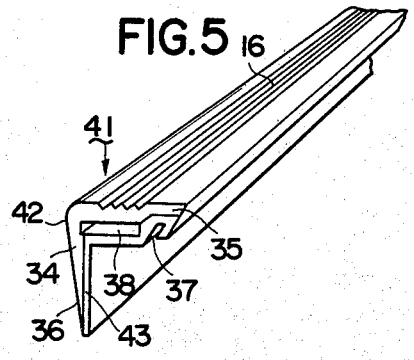
FIG. 6
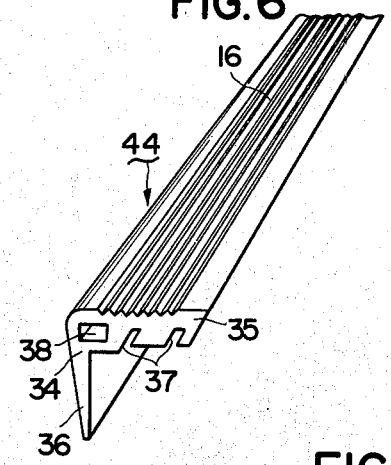
FIG. 7
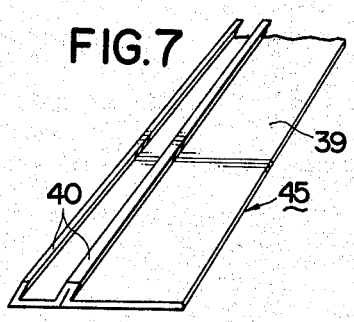
FIG. 8
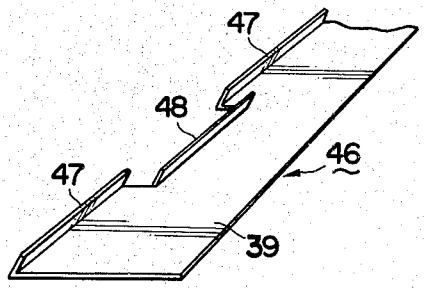

STAIR MAT

BACKGROUND OF THE INVENTION

This invention relates to a stair mat adapted to be installed on stairs, especially stairs located inside of a building.

In general, stair nosings are installed on the edge of steps for the purpose of preventing a person from missing his or her footing on the stairs and of eliminating the danger attended with such accidents. Further, carpeting is applied to the stairs for ornamental and sound absorption purposes, as well as to impart, a buffer action, thermal insulation and flexibility, such carpeting being fixed by stair rods.

However, when only stair nosings are installed, sound absorption, thermal insulation and the flexibility are lacking on the steps and the buffer action is insufficient; moreover, in the case of laying only carpeting on the stairs, the carpeting is worn away at the edge of the steps, and must be changed frequently and further becomes dirty more quickly. The frequent changing and or cleaning of the rub becomes expensive, and the tendency is to install the stair nosing and a narrow carpet as one united body or such stair nosing and narrow carpeting may be installed separately on the steps. The former, however, is not economical because the stair nosing or the carpet may be worn away or damaged and one must replace the whole unit. The latter method is not advisable because it is difficult to affix one to the other when the stair nosing and carpet are installed separately. Furthermore it brings into existence undesirable dispersion, for the combination must be installed in a manner such that the stair nosing and the carpet are put side by side or one above the other by driving in a nail or screw.

SUMMARY OF THE INVENTION

One object of the present invention is to provide a stair mat which can prevent one from missing his footing on the stairs and thus protect a person from falling on a stair. This is generally achieved by covering the edge of the stair with a nonskid cushioned stair mat having excellent sound absorption, thermal insulation, flexibility and ornamentality.

Another object of the present invention is to provide a stair mat which can be easily installed on each of the steps, being clear of undesirable dispersion and can be easily changed according to the extent of wear and damage.

BRIEF DESCRIPTION OF THE DRAWINGS

The above and other objects and attendant advantages of the present invention will be more readily apparent to those skilled in the art from the following description when read in connection with the accompanying drawings, in which:

FIG. 4 is a fragmentary deal perspective view of the embodiment as shown in FIG. 3;

FIG. 5 is a fragmentary perspective view of a modification of the edge cushion cover of a flexible synthetic resin adapted to a stair mat as shown in FIGS. 3 and 4;

FIG. 6 is a fragmentary perspective view of a further modification of the edge cushion cover of flexible synthetic resin adapted to a stair mat as shown in FIGS. 3 and 4;

FIG. 7 is a fragmentary perspective view of a modification of the connecting base sheet member adapted to the edge cushion cover as shown in FIG. 6;

FIG. 8 is a fragmentary perspective view of a further modification of the connecting base sheet member adapted to the edge cushion cover as shown in FIG. 6;

DETAILED DESCRIPTION OF THE INVENTION

Figure 1:
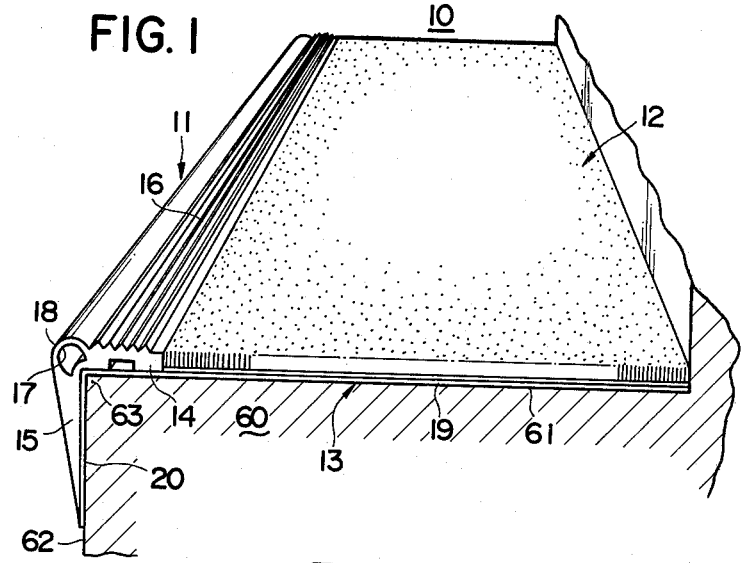
FIG. 1 is a perspective view of a preferred embodiment of a stair mat installed on the stairs of a building.
Figure 2:
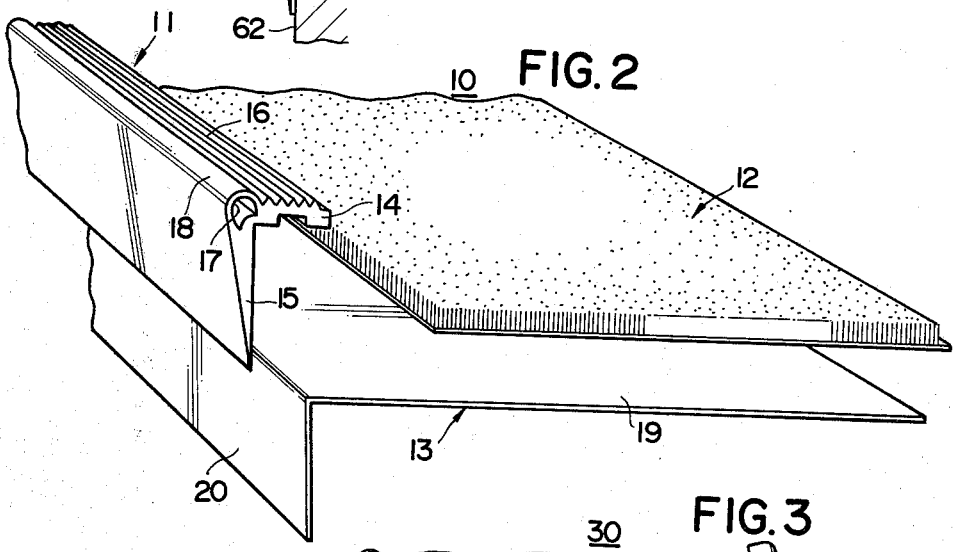
FIG. 2 is a fragmentary deal perspective view of the embodiment as shown in FIG. 1.

The present invention will be now described referring to the accompanying drawings and more particularly, to FIGS. 1 and 2 in which the first embodiment of the stair mat constructed in accordance with the present invention is shown. The stair mat is generally shown with reference numeral 10 and installed on the stairs 60 of a building.

The stair mat 10 includes an edge cushion cover 11, a tread mat 12 and a thin connecting base sheet member 13 fixing the edge cushion cover 11 and the tread mat 12 on a tread 61 of a step 60.

The edge cushion cover 11, which may be produced from flexible synthetic resin of polyvinyl chloride resin, urethane or the like, is formed in a L-shaped cross-section, a main body 14 of a horizontal strip having a required width is provided downwards with a skirt 15 at the end. The main body 14 has a non-skid top surface portion 16 on the upper surface, such as serrations of its cross-section, and has a cavity 17 at the inside, inparting to the main body a similar elasticity to that of the tread mat 12. A hollow distended portion 18 is formed at a border of the main body 14 and the skirt 15, the distended portion 18 has a non-skid effect, and is elastic. The edge cushion cover 11 as above-mentioned, is integrally united with the edge of the L-shaped connecting base sheet member 13, laying the main body 14 on a main sheet 19 of the L-shaped connecting base sheet member and also laying the skirt 15 on an anchoring sheet 20 of the L-shaped connecting base sheet member 13.

The tread mat 12 is a common carpet, a deep-pile carpet or the like, keeping its fringes in curl so as not to be frayed, and also lined with a hemp cloth on the under surface, which is adhered continuously backwards from the edge cushion cover 11 on the main sheet 19 of the connecting base sheet member 13.

The above-mentioned tread mat 12 can be substituted for the felt, and can be cut into various shapes, for example, rectangular, semi-circular, semi-elliptic, trapezoidal, and so on. Hereupon in general, the carpet is formed in the manner of working hair into a base sheet of a thin paper or the like, then pasting a base cloth of the hemp or the like on the base sheet, and keeping its fringes in curl as being cut. However, when the tread mat 12 produced like that is set on the main sheet 19 of the connecting base sheet member 13 as it is, it is thick because it overlaps the tread mat 12 and the connecting base sheet member 13, and it is does not have a good appearance at the curled fringe. Therefore, in practice it is desirable that an unfinished carpet having woven hair into the base sheet, without the base cloth, is adhered on the main sheet 19 of the connecting base sheet member 13, and the fringe is held by an edging member which is formed in a bent fashion as a U-shaped plane figure so as to prevent fraying of the fringe.

The connecting base sheet member 13 serves to connect the edge cushion cover 11 and the tread mat 12 and hold the edge cushion over 11 and the tread mat 12 place, which tread mat is fairly weighty, and is produced from an easily unbendable material, for example a semi-rigid synthetic resin, and is formed from an L-shaped cross section, comprising a horizontal main sheet 19 of a thin plate adapted to cover the entire the surface of the tread 61 of the step 60, and an anchoring sheet bent at a right angle to the main sheet 19 so as to adapt to the riser 62 of the step 60.

In the installation of the stair mat 10 of the present invention which the edge cushion cover 11 and the tread mat 12 are fixed integrally on the upper surface of the connecting base sheet member 13, a double-faced adhesive tape is attached to several parts of the under surfaces of the main sheet 19 and the anchoring sheet 20 of the connecting base sheet 13, and the main sheet 19 is adhered on the tread 61 of the step 60 and also the anchoring sheet 20 is adhered on the riser 62 of the step 60, respectively. In consequence, the tread mat 12 is fixed to the entire surface of the tread 61 of the step 60, and the edge cushion cover 11 is fixed at the edge, that is to say at the nosing of the step 60. Due to the edge cushion cover 11 and the tread mat 12, the stair mat has excellent sound absorption, shock absorption, thermal insulation, and so on, in addition to the non-skid properties as above-mentioned. Since the non-skid top surface portion 16 and the distended portion 18 of the edge cushion cover 11 gives flexibility, there is no feeling of physical discomfort when a person steps on the edge cushion cover 11 and the tread mat 12 at the same time.

If a fluorescent member is provided on the non-skid top surface portion 16 of the edge cushion cover 11, the forward edge 63 of each step 60 is visible in the dark at the night and it is easy to go up and down the stairs 60.

Figure 3:
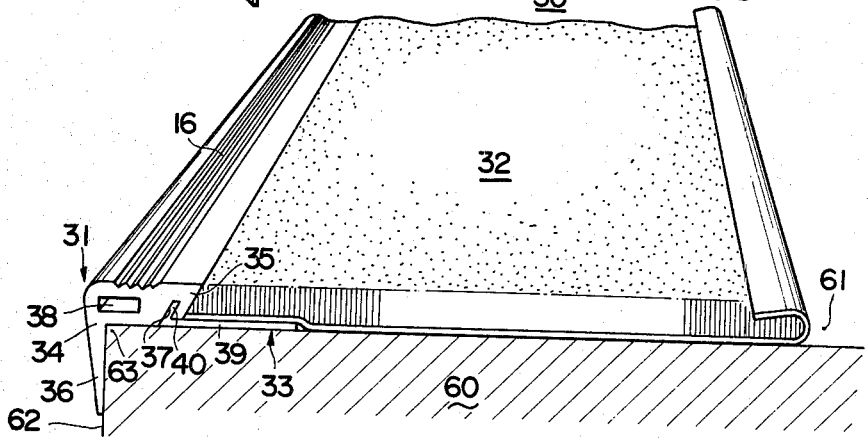
FIG. 3 is a fragmentary perspective view of a modified embodiment of the stair mat of the present invention, which is installed on the stairs of a building.

FIGS. 3 and 4 show a modified embodiment 30 of the stair mat of the present invention, which is installed on the stairs 60 of the building.

The stair mat 30 includes an edge cushion cover 31 having flexibility, a tread mat 32 and a thin connecting base sheet member 33 fixing the edge cushion cover 31 and the tread mat 32 on the tread 61 of the step 60 so as to connect the tread mat 32 with the edge cushion cover 31.

The edge cushion cover 31, which may be produced from a flexible synthetic resin is formed into an L-shaped cross-section and is integrally providing downwards with a skirt 36 at the edge.

The edge cushion cover 31 is provided with a catching groove 37 extended in a longitudinal direction, being adjacent to the rear end on the under surface, and is provided with a hollow portion 38 passed through in a longitudinal direction, heightening the cushioning effect. The edge cushion cover is further provided with a non-skid top surface portion 16 on the upper surface, such as serrations to heighten the non-skid effect.

The tread mat 32 is a common carpet, a deep-pile carpet or the like, which is set at the front edge on the connecting base sheet member 33, and is fixed on the connecting base sheet member 33 by an adhesive agent or a double-faced adhesive tape.

The connecting base sheet member 33 is provided with a hook-shaped rib 40 formed by bending upwardly one side edge of a thin strip plate, which is able to connect with the edge cushion cover 31, putting the hook-shaped rib 40 into the catching groove 37 of the edge cushion cover 31. The tread mat 32 is set on a fitting surface 39 of the connecting base sheet member 33 and is fixed on the fitting surface 39, being adjacent to the edge cushion cover 31.

In the installation of the edge cushion cover 31 and the tread mat 32 by the use of the connecting base sheet member 33, the edge cushion cover 31 and the connecting base sheet member 33 are fixed on the nosing of the step 60 by an adhesive agent by putting the hook-shaped rib 40 of the connecting base sheet member 33 into the catching groove 37 of the edge cushion cover 31, and then the tread mat 32 is adhered on the tread 61 of the step 60, and the front edge of the tread mat 32 is then set on the fitting surface 39 of the connecting base sheet member 33 fixed on the step 60. The connecting base sheet member 33 at the fitting surface 39 may be fixed on the under surface of the edge of the tread mat 32 before the installation. In the installation, the connecting base sheet member 33, the tread mat 32 and the edge cushion cover 31 are fixed on the step 60 by an adhesive agent, and the hook-shaped rib 40 of the connecting base sheet member 33 is put into the catching groove 37 of the edge cushion cover 31.

The above-mentioned edge cushion cover 31 is described as being formed of a flexible synthetic resin. As shown in FIG. 5, the edge cushion cover 41 may be comprised of an upper surface layer 42 of flexible synthetic resin and a lower surface layer 43 of rigid synthetic resin.

Since the catching groove 37 is provided on the lower surface layer 43 of the rigid synthetic resin of the edge cushion cover 41, the connection of the hook-shaped rib 40 of the connecting base sheet member 33 and the catching groove 37 is strengthened, and the installation on the nosing 63 of the step 60 is firm.

FIG. 6 shows a further modification 44 of the edge cushion cover in which the edge cushion cover 44 is provided with two parallel catching grooves 37, 37 extended in the longitudinal direction on the under surface, thereby strengthening the connection with the connecting base sheet member 33, which is adapted to be installed on the stairs, especially stairs used frequently.

FIGS. 7 and 8 show a modification of the connecting base sheet member 45, 46 adapted to the edge cushion cover 44 as shown in FIG. 6, the edge cushion cover 44 is provided with two parallel hook-shaped ribs 40, 40 at one edge of the thin plate, or the edge cushion cover 44 is provided with parallel hook-shaped ribs 47, 48 formed by cutting at proper intervals one edge of a thin plate and bending the edges upwardly in parallel with the edge.

Figure 9:
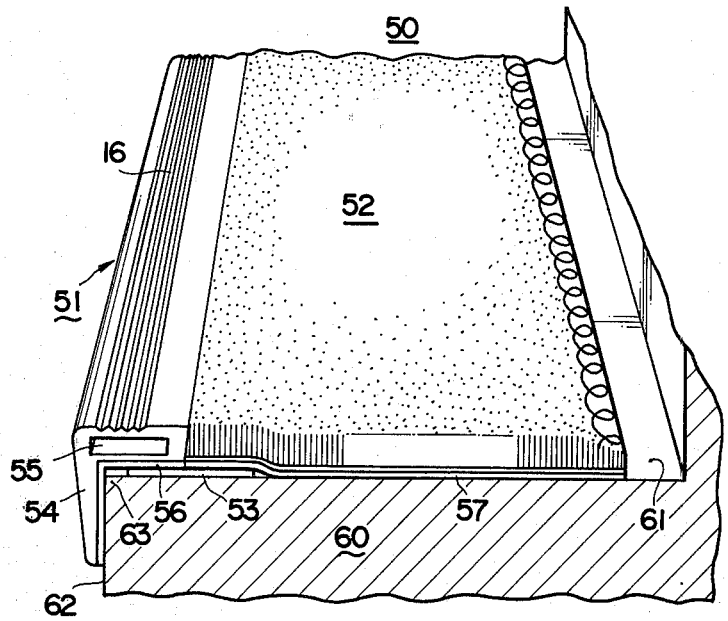
FIG. 9 is a fragmentary perspective view of a further modified embodiment of the stair mat of the present invention, which is installed on the stairs of a building.
Figure 10:
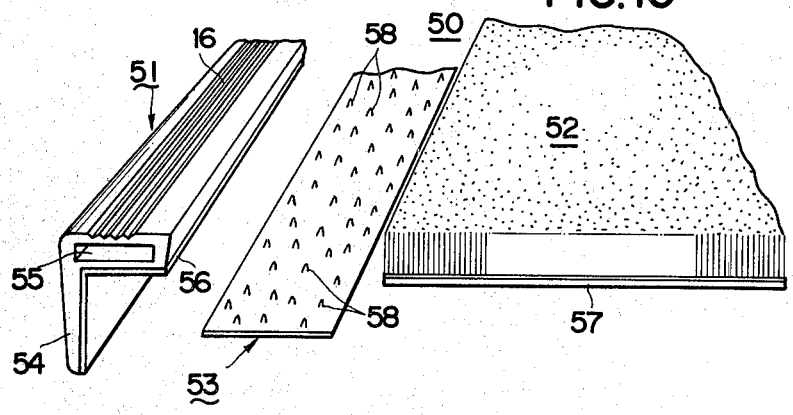
FIG. 10 is a fragmentary deal perspective view of the stair mat as shown in FIG. 9.
Figure 11:
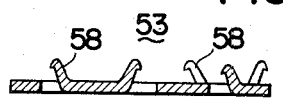
FIG. 11 is a cross-sectional view of the connecting base sheet member show in FIG. 10.

FIGS. 9 through 11 show a further modified embodiment 50 of the stair mat of the present invention, which is installed on stairs 60 of a building.

The stair mat 50 comprises an edge cushion cover 51, a tread mat 52 and a thin connecting base sheet member 53 fixing the edge cushion cover 51 and the tread mat 52 on the tread 61 of the step 60.

The edge cushion cover 51 is formed into an L-shaped cross-section from a flexible materials, for example flexible synthetic resin, which is provided with a hollow portion 55 passed through in a longitudinal direction and is provided with a non-skid top surface portion 16 on the upper surface, such as serrations on the upper portion thereof.

Further the edge cushion cover 51 is provided with a flexible connecting layer 56 in one united body on the under surfaces of the main body and the skirt 54. The flexible connecting layer 56 is formed of latex, a plastic foam or the like.

The tread mat 52 is a common carpet, a deep-pile carpet, a foot-cloth or the like, which is formed in a manner of working out the pile into a base cloth 57 of a hemp cloth or a hemp cloth with latex, and which is covered at the fringe, except for the forward edge with a hemstitch of the same kind of the tread mat, a cloth or a plastic sheet, so as not to be frayed.

The connecting base sheet member 53 is formed of a thin strip plate having a large number of thorns 58 projecting on the upper surface, which enables one to connect the edge cushion cover 51 and the tread mat 52 by thrusting a large number of thorns 58 into the flexible connecting layer 56 of the edge cushion cover 51 and the base cloth 57 of the tread mat 52.

In the installation of the stair mat 50, the connecting base sheet member 53 having the same length as the edge cushion cover 51 as shown in FIGS. 10 and 11 is fixed on the tread 61 adjacent to the nosing 63 of the step 60 by an adhesive agent. The edge cushion cover 51 then is pressed onto the connecting base sheet member 53 to cover the nosing 63 so as to thrust a large number of thorns 58 into the flexible connecting layer 56 of the edge cushion cover 51. The tread mat 52 is also pressed at the front edge on the connecting base sheet member 53, being adjacent to the rear edge of the edge cushion cover 51, so as to thrust a large number of thorns 58 into the base cloth 57 of the tread mat 52. The tread mat 52 is then detachably fixed on the tread 61 by an adhesive tape or the like so as to be changed as occasion demands.

The stair mat 50 is comprised as above-mentioned. The edge cushion cover 51 is fixed on the nosing 63 of the step 60 and the edge cushion cover 51 is fixed on the tread 61 of the step 60 and they are connected by the connecting base sheet member 53 so as to thrust a large number of thorns 58 of the connecting base sheet member 53 into the flexible connecting layer 56 of the under surface of the edge cushion cover 51 and the base cloth 57 of the under surface of the tread mat 52, respectively. By this procedure, the edge cushion cover 51 and the tread mat 52 can be easily changed as occasion demands as the mat is either worn or soiled. Owing to a large number of thorns 58 of the connecting base sheet member 53, the installed position of the edge cushion cover 51 and the tread mat 52. This prevents the disfigurement attended with inducing a needless gap, and prevents as well the wear and tear at the front edge of the tread mat 52. In spite of the edge cushion cover 51 and the tread mat 52 being produced separately, the stair mat 50 connects an edge cushion cover 51 and the tread mat 52 can be used safely as produced in one united body.

While several preferred embodiments of the invention have been shown and described in detail, it will be understood that the same are for illustration purposes only and not to be taken as a definition of the invention; reference being had for this purpose to the appended claims.

What is claimed is:

1. A stair mat comprising:

an edge cushioning cover having an L-shaped cross-section adapted to cover the forward edge of a step, including a main body adapted to extend across the front of a step with a non-skid top surface and having at least one catching groove at its under surface and a skirt extending vertically downward from the main body portion and adapted to cover a riser of a step, said L-shaped edge cushioning cover having an upper layer made of a flexible synthetic resin and a lower layer made of a rigid synthetic resin;

a connecting base sheet member adapted to be fixed on the tread of a step and having at least one hook-shaped rib at the forward edge thereof, said rib or ribs being fitted into the catching groove or grooves of the main body of the L-shaped edge cushioning cover; and a tread mat secured at the upper surface of the connecting base sheet member, behind the edge cushioning cover, said base sheet member and tread mat being connected to the edge cushioning cover by means of the interlocking arrangement of said rib or ribs of the base sheet member being accommodated into said groove or grooves of the edge cushioning cover.

2. A stair mat as claimed in claim 1, in which the edge cushioning cover is provided with a longitudinal hollow portion between the said upper surface and the lower surface resin layers.

3. A stair mat as claimed in claim 1, in which the non-skid top surface portion is serrated.

4. A stair mat as claimed in claim 1, in which the main body of the edge cushioning cover has two parallel catching grooves extended in the longitudinal direction on the under surface thereof, and the connecting base sheet member is provided with a plurality of parallel bent hook-shaped ribs accommodated in the catching grooves of the edge cushioning cover.

* * * * *